US010464725B2

(12) United States Patent
Hlavacek

(10) Patent No.: US 10,464,725 B2
(45) Date of Patent: Nov. 5, 2019

(54) CONTAINER CLOSURE WITH LATCHING COLLAR

(71) Applicant: ALPLA WERKE ALWIN LEHNER GMBH & CO. KG, Hard (AT)

(72) Inventor: Thomas Hlavacek, Bregenz (AT)

(73) Assignee: ALPLA WERKE ALWIN LEHNER GMBH & CO. KG (AT)

( * ) Notice: Subject to any disclaimer, the term of this patent is extended or adjusted under 35 U.S.C. 154(b) by 411 days.

(21) Appl. No.: 15/321,654

(22) PCT Filed: May 20, 2015

(86) PCT No.: PCT/EP2015/061102

§ 371 (c)(1),
(2) Date: Dec. 22, 2016

(87) PCT Pub. No.: WO2015/177205

PCT Pub. Date: Nov. 26, 2015

(65) Prior Publication Data

US 2017/0158392 A1 Jun. 8, 2017

(30) Foreign Application Priority Data

May 20, 2014 (CH) ..... 0761/14

(51) Int. Cl.
*B65D 53/02* (2006.01)
*B65D 47/20* (2006.01)

(52) U.S. Cl.
CPC ..... *B65D 53/02* (2013.01); *B65D 47/2006* (2013.01); *B65D 2255/20* (2013.01)

(58) Field of Classification Search
CPC .... B65D 50/045; B65D 50/061; B65D 39/00; B65D 53/02; B65D 43/0214; B65D 47/2006; B65D 47/2012; B65D 47/20; B65D 47/06; B65D 47/068; B65D 47/12; B65D 47/141; B65D 47/14; B65D 47/121;

(Continued)

(56) References Cited

U.S. PATENT DOCUMENTS 1,999,113 A * 4/1935 Shapiro ..... B65D 55/04 215/250
4,260,067 A * 4/1981 Andruchiw ..... B65D 50/06 215/216

FOREIGN PATENT DOCUMENTS

| | | |
|---|---|---|
| DE | 10160362 | 6/2003 |
| EP | 1086903 | 3/2001 |
| WO | 2008080053 | 7/2008 |

* cited by examiner

*Primary Examiner* — Robert J Hicks
(74) *Attorney, Agent, or Firm* — Morriss O'Bryant Compagni Cannon, PLLC

(57) ABSTRACT

The invention relates to a container closure made of plastic, comprising a lower closure part, which can be fastened to an opening of a container. Of the invention, the lower closure part has a collar, which can be inserted into the opening of the container. The at least one locking projection can be moved in the direction of a center axis of the lower closure part in a reversible elastic manner in relation to the collar. The at least one locking projection is designed in such a way that, when the at least one locking projection and an undercut shaped in the opening engage with each other, the at least one locking projection and said undercut form a lock that cannot be detached in the direction of the center axis. The collar has at least one through-hole, and the locking projection can be displaced through the through-hole.

26 Claims, 6 Drawing Sheets

(58) Field of Classification Search
CPC ..... B65D 25/48; B65D 25/42; B65D 25/40; B65D 1/0246
USPC ..... 215/355, 364, 359, 358, 225, 224; 220/802, 801, 796, 319; 222/570, 569, 222/567, 566, 563, 562
See application file for complete search history.

CONTAINER CLOSURE WITH LATCHING COLLAR

CROSS-REFERENCE TO RELATED APPLICATIONS

This application is a national phase entry under 35 U.S.C. § 371 of PCT/EP2015/061102 filed on May 20, 2015, which claims priority to Swiss Patent Application 00761/14 filed on May 20, 2014, the entirety of each of which is incorporated by this reference.

BACKGROUND

The invention relates to a container closure.

PRIOR ART

Plastic closures for containers (bottles, tubes etc.) are usually screwed or plugged onto a spout portion, wherein a collar of the closure fits over the spout portion. DE-OS 101 60 362 is mentioned as an example for a plurality of such closures, which discloses a closing cap for a glass bottle. The closing cap has a collar, which fits over the mouthpiece of the glass bottle. To fix the closing cap, the internal surface of the coating of the collar has inwardly protruding locking projections, which can positively interact with undercuts being provided on the outside of the bottleneck. On the collar, a hinged lid is arranged, which is separated from the collar by a predetermined breaking point when the bottle is to be opened and the bottle contents are to be made available. Such closures can also be designed as a flip-top closure or as a screw cap, which can be screwed onto a spout portion of a bottle.

A disadvantage of the known closures that they are relatively bulky and heavy and their manufacture therefore requires a lot of material. Aesthetically, it would also often be desirable if the closure were to take up less space, so that it would be more visually appealing.

Advantages

It is therefore advantageous to provide a container closure that can be fastened to an end portion of a container, which is inexpensive to produce, requires little space and is aesthetically pleasing. Furthermore, the closure should ideally offset the production tolerances of the end portion of the container without loss of functionality.

SUMMARY OF THE INVENTION

The advantages are achieved by the subject matter according to the independent claims. Further advantageous embodiments of the invention are defined in the dependent claims.

According to a first embodiment of the invention, a container closure made of plastic with a lower closure part is proposed, which can be fastened to an opening of a container. The lower closure part comprises a collar which can be inserted into the opening of the container. The at least one locking projection can be moved in the direction of a center axis of the lower closure part in a reversible elastic manner in relation to the collar. The at least one locking projection is designed in such a way that, when the at least one locking projection and an undercut shaped in the opening engage with each other, the at least one locking projection and said undercut form a connection that cannot be detached in the direction of the center axis.

The proposed container closure can be produced using the injection molding process from the conventional thermoplastic plastics such as PET, PP, PE and their mixtures. The collar of the lower closure part is usually designed as a circular hollow cylinder. The term "reversible elastic" is to be understood such that the locking projection axis can be moved from its rest position under the influence of a predetermined radially effective force by a predetermined measure in the direction of the center axis into a deflected position and can substantially be automatically returned or rebounded from this deflected position into its rest position if the radially effective force is omitted. The locking projection can thereby substantially function as a leaf spring. The at least one locking projection can be formed on the lower closure part. However, particularly if more than one locking projection is used, the locking projections can be arranged on a rim, wherein the rim is a separate component, specifically a plastic injection molded component. The rim with the locking projections can be non-detachably connected with the lower closure part, for example, by projections formed on the rim, which lock with recesses formed supplementary to the projections in the lower closure part, or vice versa. It may thereby be possible to produce the lower closure part from a different plastic to the rim with the locking projections. For example, the locking projections can be produced from a viscoplastic material, whereas the lower closure part can be produced from a brittle hard plastic material. The lower closure part with the at least one locking projection can be integral. The container closure can be designed to be repeatedly inserted into the opening of the container, which can be made of any material such as plastic, glass or metal, and removed from the opening. The container closure can thus be used for repeatable closure of sealing of storage containers. The storage containers can store liquids, which may be viscous, pastes or pourable material. Here, the container closure can be designed to be impermeable to the media stored in the storage container. The container closure may also have a removal opening such as a nozzle, which can generally be closed using a lid. The lid can be securely attached to the lower closure part and form the container closure. Through a removal possibility of the container closure from the opening, the container, which is sealed with said container closure, can be refilled. To remove a container closure of the opening, the opening can comprise for example an undercut just in at least one portion, wherein the portion adjoining the undercut in the circumferential direction is designed to be free of undercuts, generally smooth. Further, the undercut and/or a portion of the locking projection being locked with the undercut in the circumferential direction can comprise a bevel, which enables or at least facilitates a separation of the lock through the relative radial movement of the container closure to the opening of the container. The container closure can be inserted into the opening until for example a band of the container closure adjacent to the collar, whose outer diameter can be larger than the collar, is applied at an edge adjoining the opening in the pouring direction. When a lock of the locking projection does not occur with the undercut by inserting the container closure along the center axis, i.e. through an axial movement, a locking together of the locking projection and the undercut can be effected through a radial movement, i.e. by turning the container closure around the center axis. A removal of the container closure may be effected by disengaging it with the undercut by means of a rotational movement of the locking projection over the bevel. To simplify the removal and/or insertion of the container closure, stops and/or guides may be provided. The undercut of the opening can be formed as a radial projection extending in the circumferential direction, such as a bead, or as a radial recess extending in the circumferential direction, such as a groove or channel. The undercut can also extend over the entire circumference of the opening. The container closure can thus possibly be rotatable configured, but can be non-detachably connected after the locking together of the locking projection and the undercut. Since the locking projection can be moved in a reversible elastic manner in the radial direction, the locking projection can offset production tolerances of the opening and the container closure such that the snap lock creates a reliable connection being non-detachable in the axial direction when engaging with the undercut. In general, the connection being non-detachable in the axial direction is substantially achieved by positive locking and only becomes a negligible part through the pretension of the locking projection. In order to position the container closure in a predetermined position in the circumferential direction, a first fixing element may be formed, for example, on the container closure, which engages with a second fixing element corresponding with the first fixing element and being formed in the opening. Further, the proposed container closure may have the advantage that it can be constructed very compactly, and that less material is needed for its production than for container closures, which overlap the container opening.

According to another embodiment of the invention, the collar comprises at least one through-hole, wherein the at least one locking projection can be displaced by the at least one through-hole. Thereby, the displacement path of the locking projection cannot be restricted by the collar in the radial direction towards the center axis or away from the center axis. The at least one locking projection can be arranged on an outer wall of the collar facing away from the central axis or on an internal wall facing towards the center axis and opposite the external wall or on a wall of the collar adjacent to the through-hole. Furthermore, more than one locking projection can be arranged in a through-hole. The locking projection can also have in its reversibly displaceable or resilient portion a wall thickness that is different to the collar. The through-hole is normally formed as a rectangle. The locking projections can also be arranged diametrically opposite one another or substantially be distributed regularly over the area. This may have the advantage that the lower closure part, once inserted into an opening, is reliably maintained.

According to a further embodiment of the invention, a geometric configuration of a side facing the center axis of a reversibly elastic portion of the at least one locking projection and a geometric configuration of an internal wall of the collar facing the center axis correspond substantially to one another. For example, the side facing the center axis of the portion can be substantially flush with the internal wall facing the center axis of the collar. This may mean that in the present embodiment, the side facing the center axis of the portion is flush with the internal wall of the collar both in the extension direction of the center axis and transverse to the extension direction of the center axis. If the internal wall of the collar is formed for example as a circular cylinder, said side can be formed as a portion of the circular cylinder with the same radius as the inner side. Further, the geometric configuration of said side and the geometric configuration of the internal wall facing the center axis can jointly include a predetermined angle. Thus, the reversibly elastic portion can already radially overlap the collar. Of course, the geometrical configuration of a side facing away from the center axis of a reversibly elastic portion of the at least one locking projection and a geometrical configuration of an internal wall facing the center axis of the collar, namely the outer wall, can correspond substantially with each other.

According to a further embodiment of the invention, the collar of the container closure comprises a base. The base is located opposite a band, which overlaps the opening if the lower closure part is inserted into the opening. The at least one locking projection is integrally formed on the base and extends in the direction of the band. Of course, if a rectangular through-hole is based on the following view, the locking projection could also be non-detachably connected to a side opposite the base or to a side adjoining the base. It has however been shown that tensile forces acting on the container closure mounted in the opening are highest if the locking projection is connected to the base.

According to another embodiment of the invention, the collar is formed on a larger-diameter band, wherein an annular step is formed between the band and the collar. The band and the opening may be flush with one another on their external sides for aesthetic reasons, if the container closure is mounted in the opening. The annular step can for example be formed as a cone, which tapers in the direction of the collar from the band. The cone can act in a sealing manner in an interplay with the opening, such that a discharge of a substance stored in the container can be prevented between the opening and the container closure.

According to a further embodiment of the invention, the annular step is formed as an annular surface substantially extending transverse to the center axis. This annular surface can serve as a stop when fitting the container closure in the opening. The annular surface can also be formed as a sealing surface being arranged between the edge adjoining the opening and the flat seal positioned on the annual surface.

According to a further embodiment of the invention, the at least one locking projection is substantially L-shaped.

According to a further embodiment of the invention, the at least one L-shaped locking projection comprises a first axial leg, whose first end is non-detachably connected with the collar, and a second leg, wherein the first leg and the second leg include a predefined angle and the second leg is non-detachably connected to a second end being opposite the first end of the first leg. In this case, the axial leg can be the reversibly elastic portion, which acts similarly to a leaf spring. The second leg, which is generally shorter than the first leg, interacts with the undercut in the opening such that the container closure, if locked in the opening, cannot be non-destructively removed in the axial direction of the opening. The predetermined angle is generally about 90°. However, the predetermined angle can vary depending on the configuration of opening.

According to a further embodiment of the invention, the second leg is formed as a wedge. The thicker part of the wedge here can be facing the first leg and the thinner part of the wedge faces away from the first leg. This configuration of the wedge can have the advantage that the container closure can be as such easily released, as there are no undercuts. The wedge has a first wedge surface facing away from the first leg and a second wedge surface facing towards the first leg. The first wedge surface and the first leg can include an angle between 75° and 90°, between 80° and 89° or between 82° and 88°. Furthermore, the wedge-shaped configuration of the second leg can prevent the second leg avoiding the container closure at tensile load, as could happen if the second leg were to only comprise the wall thickness of the first leg.

According to a further embodiment of the invention, a continuous bottom is circumferentially formed on an internal wall of the collar. This bottom can also be designed such that it confines the band on its external edge, which is opposite to the annular step. If the bottom is formed opposite the external edge, it will generally comprise a pouring opening, which can be closed by a separate lid. The external edge here can serve as a stop for the lid. Corresponding solutions are adequately known from the prior art. Through the container closure inserted into the opening, the content of the container can be included or removed through the pouring opening.

According to a further embodiment of the invention, the collar comprises a first collar portion adjacent to the annular step with a first external diameter, and a second collar portion adjoining the first collar portion with a second external diameter, wherein the second external diameter is smaller than the first external diameter. In this way, it can be effected that the container closure can be inserted without noteworthy resistance up to a predetermined first position in the opening of the container and only upon reaching a second position downstream of the first position are the container closure and the opening centered in relation to one another in a predefined partial area of the opening. A higher force requirement can be needed here to reach the second position. The collar can also be designed such that when the first or second collar portion or a partial area of this is formed as a first sealing surface, this first sealing surface only makes contact with the opening when the second sealing surface of the opening corresponding with this first sealing surface is reached. A scraping and any associated damage of the first sealing surface formed on the collar to a partial area of the opening not belonging to the second sealing surface of the opening can be prevented. A damaged sealing surface can lead to a leakiness of the combination of container and container closure.

According to a further embodiment of the invention, a sealing surface is formed on the first collar portion. A bottom is circumferentially formed on an internal wall of the collar. The bottom is located above the at least one through-hole. The term "above" means that when the container is on its bottom and the container closure is inserted into the opening opposite the bottom, the bottom between the through-hole and the band is rooted to the internal wall of the collar. The bottom can be a level, curved or stepped design. The bottom can be also be designed in a funnel shape such that the small opening of the funnel is the inlet opening of the pouring spout. Through a relevant embodiment of the bottom, a complete emptying of the stored content can be supported. The bottom as per this embodiment example can, if the container closure is mounted in the opening, prevent an access to the at least one locking projection. The container closure can thus be tamperproof with regards the at least one locking projection connected with the bottom. The first collar portion can be formed overall as a sealing surface or also just a circumferential partial area of the first collar portion. The sealing surface can interact with a partial area of the opening corresponding with the sealing surface such that a discharge of the contents stored in the container is avoided between the container closure and the mouth. In an embodiment variation, the at least one through-hole can be arranged with the in this case at least one locking projection in the second collar portion. The first collar portion and therefore the sealing surface can thus also be formed above the at least one through-hole. Consequently upon removal of a content stored in the container through a pouring spout of the container closure mounted in the opening, this content can contact the at least one locking projection.

According to a further embodiment of the invention, the second collar portion is formed as a sealing surface. A bottom is circumferentially formed on an internal wall of the collar. The bottom is arranged below the at least one through-hole. The term "below" means that when the container is on its bottom and the container closure is inserted into the opening opposite the bottom, the bottom in the area of the base is rooted to the internal wall of the collar. The bottom here can also be a level, curved or stepped design. Likewise, the bottom can be designed in a funnel shape such that the small opening of the funnel is the inlet opening of the pouring spout. Through a relevant embodiment of the bottom, a complete emptying of the stored content through the pouring spout can be supported. The bottom as per this embodiment example can, if the container closure is mounted in the opening, not prevent an access to the at least one locking projection, but an access can be made more difficult through a relevant embodiment of the bottom. In this embodiment example, the floor can be of a stepped design and can comprise an external, annular edge area and an internal bottom surface raised in the direction of the band, which adjoins the edge area via a step. As a rule, a height of the step in the direction of the band will be about as large as the height of the locking projection or even higher. Further, the step in connection with the annular edge area will be formed such that upon meeting the maximum tolerances of the opening and of the container closure, the locking projection can be deflected so far that the locking projection does not contact the step until reaching its end position when the container closure is mounted in the opening. The radial deflection of the locking projection can prevent contact being made. The locking projection can hereby possibly be damaged. Furthermore, the step will generally be formed as close as possible to the locking projection to impede access to the locking projection as far as possible and thus to protect as far as possible from manipulations. The second collar portion can be formed overall as a sealing surface or also just a circumferential partial area of the second collar portion. The sealing surface can interact with a partial area of the opening corresponding with the sealing surface such that a discharge of the contents stored in the container is avoided between the container closure and the mouth. In an embodiment variation, the at least one through-hole can be arranged with the in this case at least one locking projection in the second collar portion. Thus, the sealing surface will generally be formed on the second collar portion below the at least one through-hole. Consequently upon removal of a content stored in the container through a pouring spout of the container closure mounted in the opening, this content cannot reach the at least one locking projection. Such an embodiment can be more suitable specifically for pourable material than the embodiment described in the previous paragraph, specifically if the container closure is designed to be removable from the opening.

According to another embodiment of the invention, sealing surfaces are formed conically on the collar portions, wherein diameters of the sealing surfaces enlarge in the direction towards the band of the container closure. The collar portions could also be cylindrically formed. However, this would require a production of both the opening and the container closure with tight tolerances. Tight tolerances however increase the cost of production. Here, the cone-shaped embodiment of the sealing surfaces can create the advantage that even larger production tolerances can thereby be compensated without content from the container being able to pass between the sealing surface of the collar portions and the corresponding sealing surfaces of the opening.

The subject of the present invention is also a container for receiving a container closure as described above, wherein the container comprises an opening, on which an undercut is formed such that the undercut and the at least one locking projection of the container closure, when engaged with each other, form a non-detachable lock in the direction of the center axis of the container closure.

According to a further embodiment of the invention, the opening is formed to cooperate sealingly with the sealing surface of the first collar portion or the sealing surface of the second collar portion of the collar of the container closure. In this way, the sealing surface arranged on the collar can be attached to a corresponding sealing surface in the opening, such that the cooperation of these sealing surfaces effectively prevents any escape between these sealing surfaces of the content stored in the container.

According to another embodiment of the invention, the container is a bottle or a tube, the openings of which can be locked by the container closure described above.

According to a further embodiment of the invention, the opening comprises a front annular section with a first internal diameter and a rear annular section with a second internal diameter, wherein the front annular section extends from an edge limiting the opening in the direction of a container base positioned opposite the opening and the rear annular section adjoins the front annular section, wherein the second internal diameter is smaller than the first internal diameter. The internal diameter of the annular sections can be dimensioned such that they correspond to the external diameters of the collar portions. A stabilization of the container closure in the opening is thereby achieved transversely to the center axis of the container closure. This stabilization of the container closure relative to the container can suggest to an end consumer a good feeling in terms of the quality of the container with mounted container closure.

According to a further embodiment of the invention, the undercut in the opening is formed as a cavity or elevation. The cavity can be a groove or a channel. The elevation will generally be formed as a bead, which is arranged as material accumulation at the opening. The bead can also be produced such that the opening is constricted at its outer side at a corresponding position.

According to a further embodiment of the invention, a combination of a container such as described in the previous and a container closure also as described in the previous is proposed.

According to a further embodiment of the invention, a sealing ring is arranged between a front wall of the opening and the annular step of the container closure. In this context, the front wall is the edge adjoining the opening. This front wall is generally designed to be level. In general, a predetermined axial force acting in the direction of the center axis of the container closure is applied to achieve a reliable seal between the sealing ring, which can be formed as a flat seal, and the front wall, or annular step respectively. This axial force may be applied by the interaction of the at least one locking projection and the undercut. For this purpose, a distance between the front wall of the opening and the annular step at the band, if the at least one locking projection and the undercut are engaged, can be smaller than the thickness of the sealing ring. When a seal is effected by means of the sealing ring, a seal between the opening and the sealing surfaces being formed on the collar can possibly be omitted. The sealing ring can also for example be integrated undetachably to the lower closure part. Further, the sealing ring can be replaced by a second component which is injection-molded onto the lower closure part, as is possible for example by means of a co-injection molding process. The sealing ring can for example be made of TPE.

BRIEF DESCRIPTION OF THE DRAWINGS

To explain the invention, exemplary embodiments of container closures are described with reference to the figures.

DETAILED DESCRIPTION OF THE ILLUSTRATED EMBODIMENTS

Figure 1:
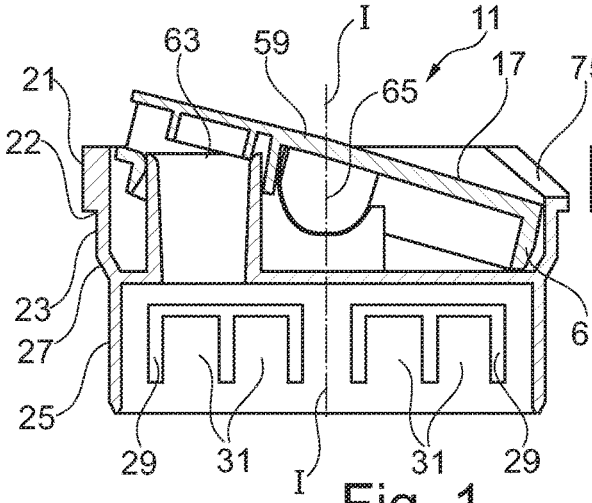
FIG. 1 shows a longitudinal section through a proposed container closure comprising a lower closure part with locking projections distributed over the area and a closing cap.
Figure 2:
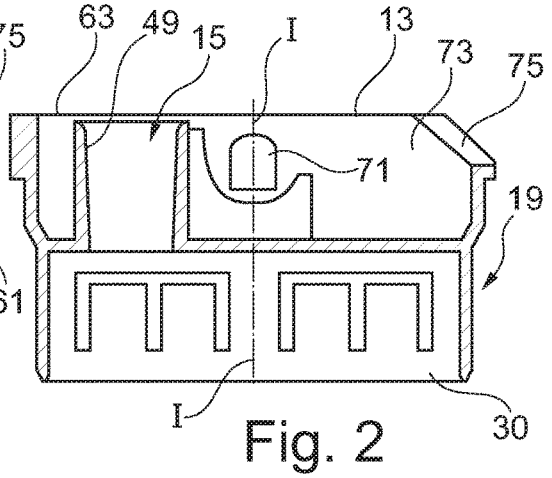
FIG. 2 shows a longitudinal section through the lower closure part from FIG. 1 without closing cap.
Figure 3:
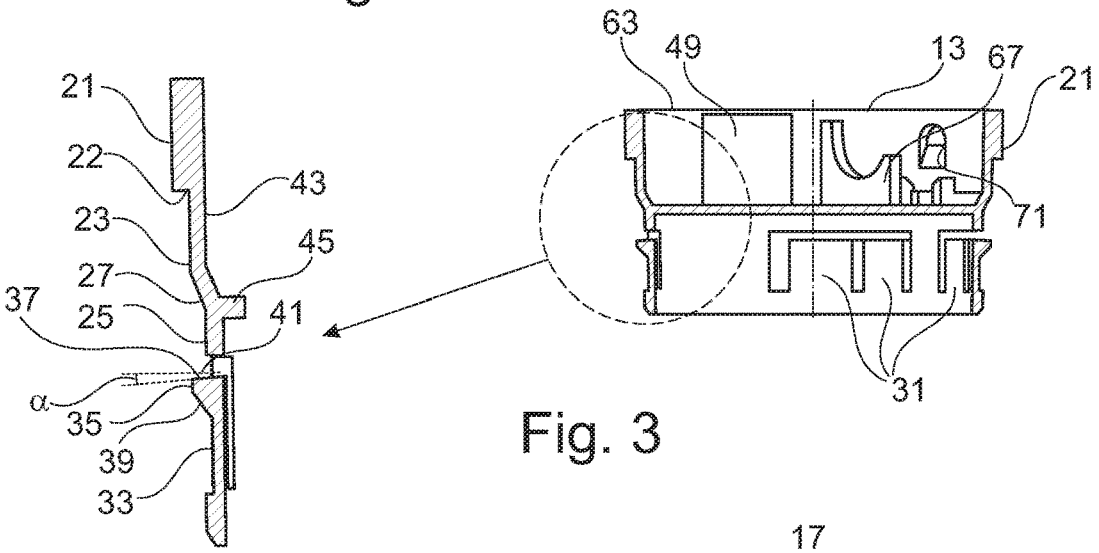
FIG. 3 shows a longitudinal section through the lower closure part from FIG. 1 and the locking projections with additional enlarged detailed view.
Figure 4:
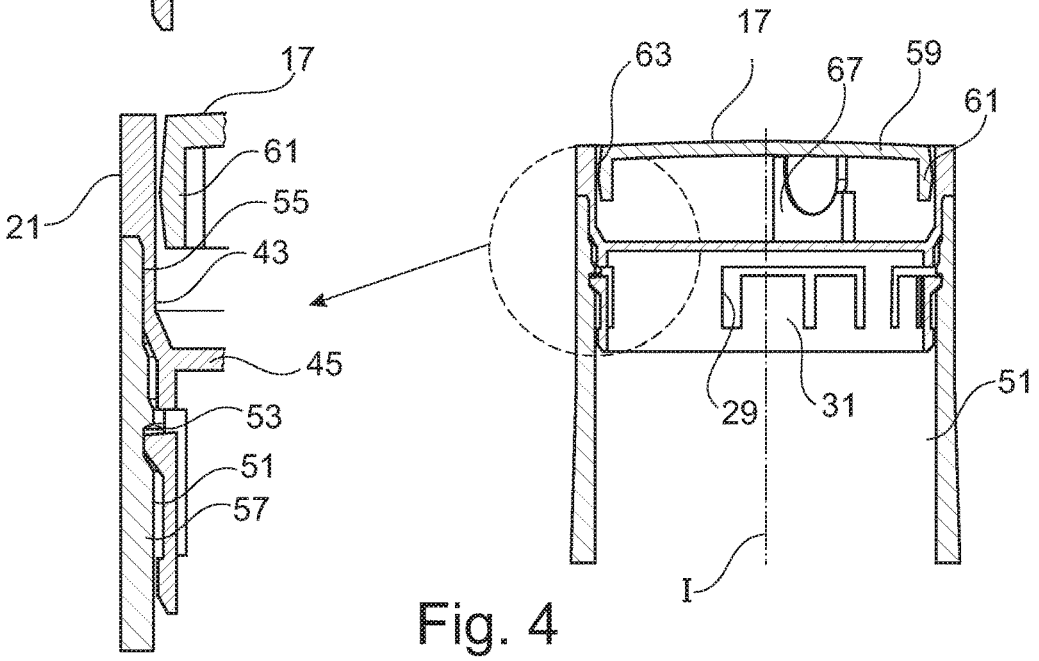
FIG. 4 shows a longitudinal section through an opening of a container with inserted container closure with additional enlarged detailed view.
Figure 5:
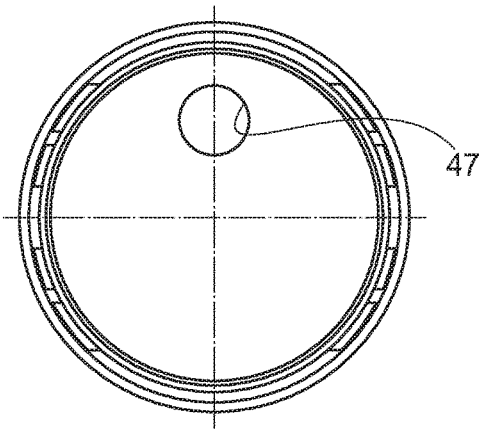
FIG. 5 shows a bottom view of the lower closure part known from FIG. 1.
Figure 6:
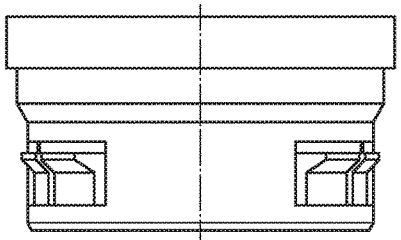
FIGS. 6 and 7 show two different lateral views of the lower closure part from FIG. 1.
Figure 7:
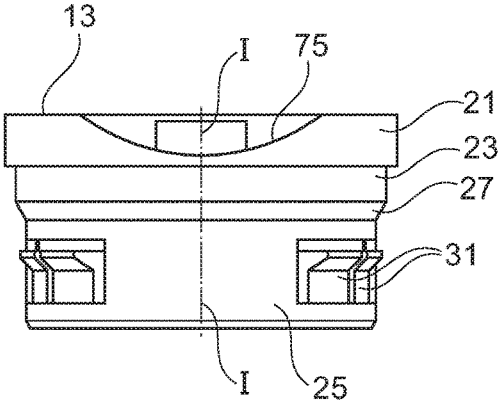
Figure 8:
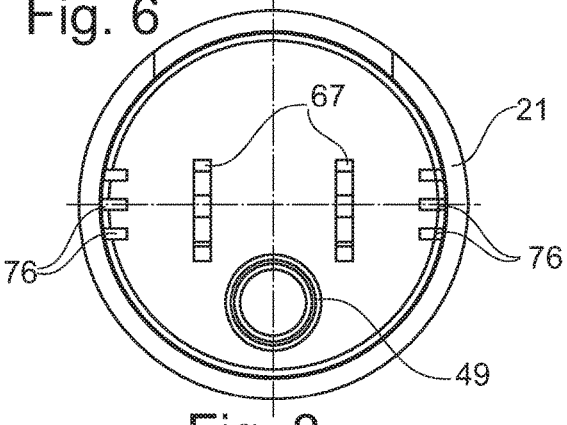
FIG. 8 shows an aerial view of the lower closure part from FIG. 1.

The plastic container closure 11 shown in FIGS. 1 to 10 comprises a one-piece lower closure part 13 with a pouring opening 15 and a cap 17 being arranged on the lower closure part 13 to close the pouring opening 15. The container closure 1 has a center axis I-I. The lower closure part 13 has a collar 19 in the form of a circular cylindrical shell, which is integrally formed on a larger-diameter band 21 with the formation of an annular step 22. The annular step 22 is formed as a circular ring. The collar 19 consists of a first collar portion 23 having a first diameter and a second collar portion 25 having a second diameter. The first 23 and the second collar portion 25 are separated from each other by a conical step 27. In the second collar portion 25, penetrations 29 are provided, in which locking projections 31 are arranged. The locking projections 31 are L-shaped in the lateral view, wherein a first leg 33 extends in the axial direction, i.e. in the direction of the center axis I-I, from which a second leg 35 substantially protrudes at a right angle in the radial direction, that is substantially transverse to the central axis I-I (FIGS. 3 and 4). The locking projections 31 are pivotably formed below at the base 30 of the second collar portion 25 relative to the collar 19 and extend in the direction of the second collar portion 25 or a band 21 being positioned opposite the base 30. Each locking projection 31, or its first leg 33, can be moved in a reversible elastic manner in the radial direction. This means that the first leg 33 acts as a leaf spring in principle. The first leg 33 can thus be displaced by applying a predetermined radially effective force from a first position to a second position and returns automatically, when the applied radially effective force is omitted, substantially into the first position. According to the represented embodiment, the second leg 35 is formed as a wedge in the cross section with a wedge surface 37 facing away from the first leg 33 and a second wedge surface 39 facing towards the first leg. In the normal position, the first wedge surface 37 with a mathematical horizontal 41 of the closure takes on an angle $\alpha$ of between 0.5° and 10° such as approximately 5°. This facilitates a demolding of the lower closure part 13 being manufactured in a plastic injection molding process.

Figure 9:
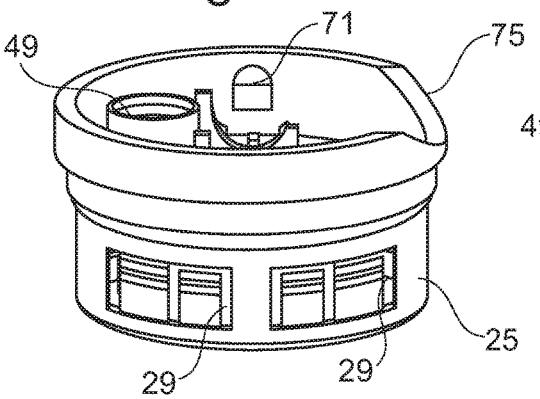
FIGS. 9 and 10 show two different perspective views of the lower closure part from FIG. 1.
Figure 10:
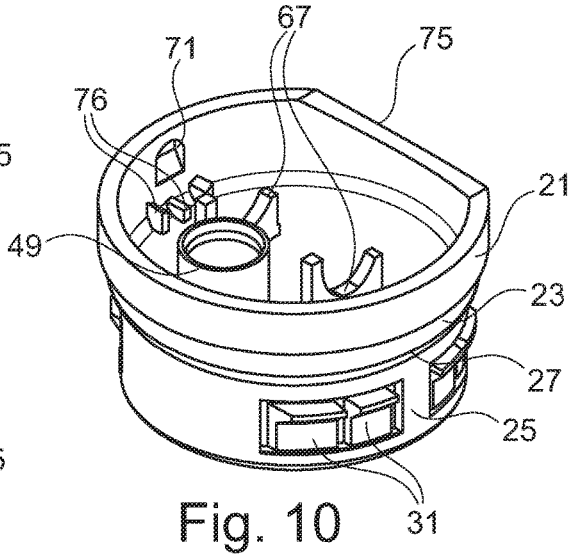
Figure 11:
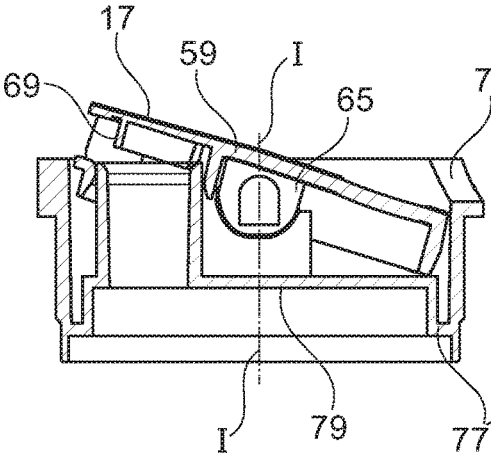
FIG. 11 shows a longitudinal section through a second embodiment of a proposed container closure consisting of a lower closure part with locking projections distributed over an area and a closing cap.
Figure 12:
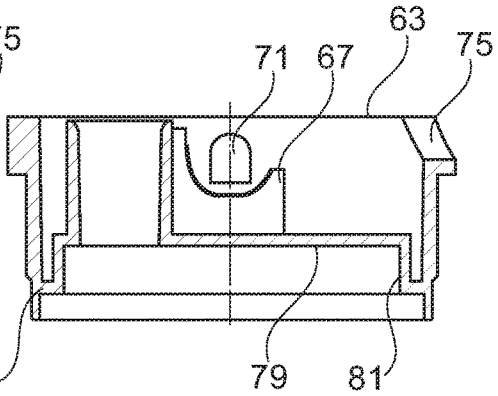
FIG. 12 shows a longitudinal section through the lower closure part from FIG. 11 without closing cap.
Figure 13:
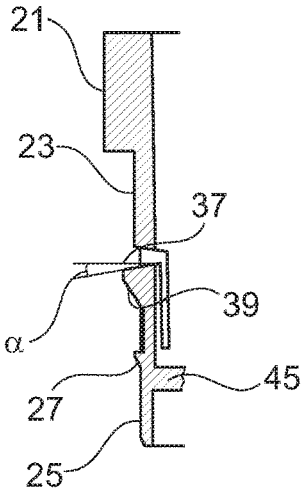
FIG. 13 shows another longitudinal section through the lower closure part from FIG. 11 and the locking projections with additional enlarged detailed view.
Figure 13:
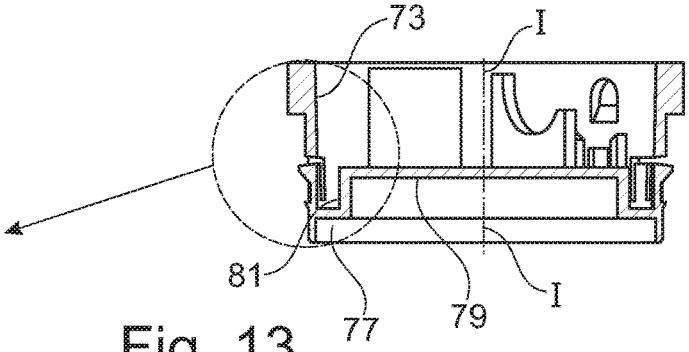
Figure 14:
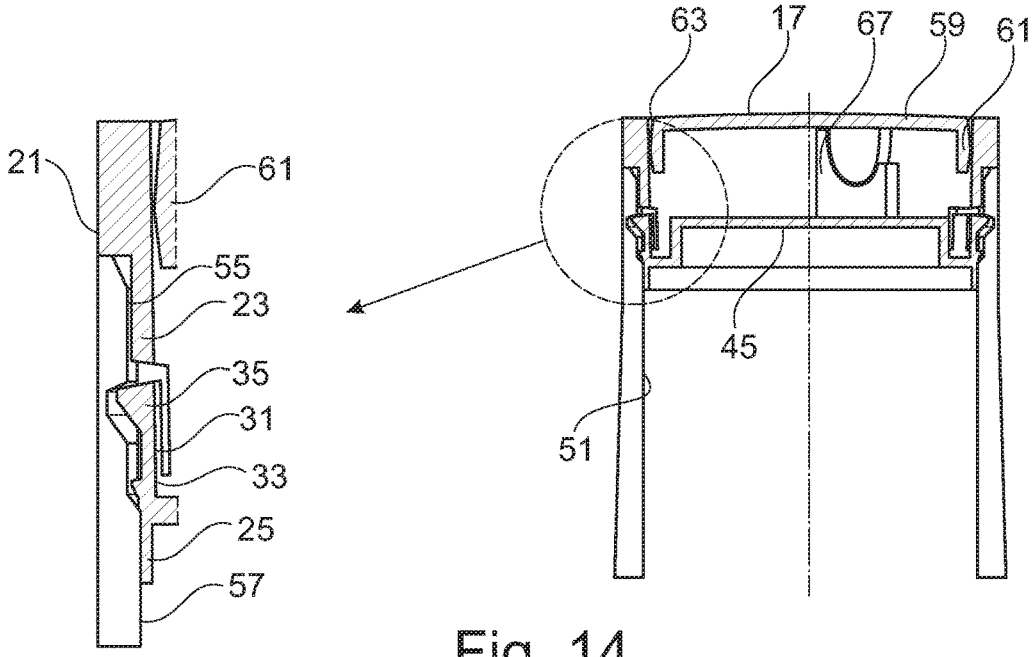
FIG. 14 shows a longitudinal section through the opening of a container with inserted container closure, as known from FIG. 11, with additional enlarged detailed view.
Figure 15:
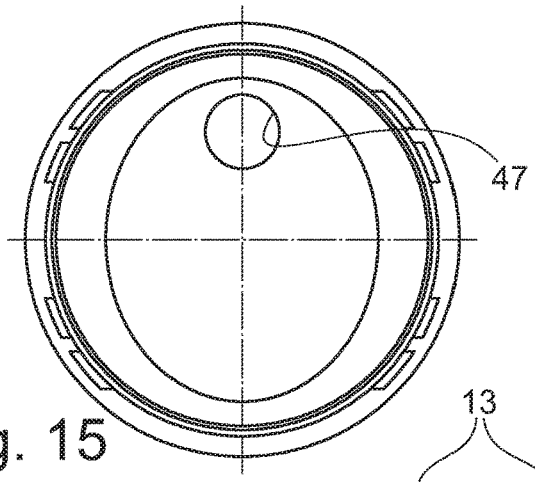
FIG. 15 shows a bottom view of the lower closure part from FIG. 11.
Figure 16:
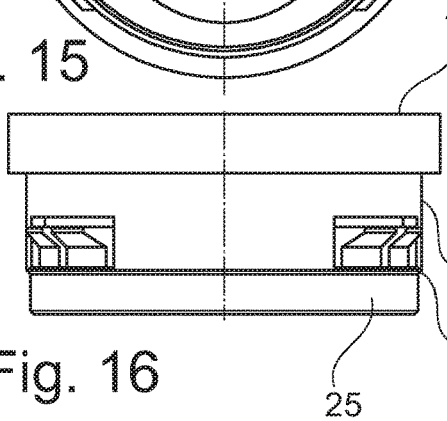
FIGS. 16 and 17 show two different lateral views of the lower closure part from FIG. 11.
Figure 17:
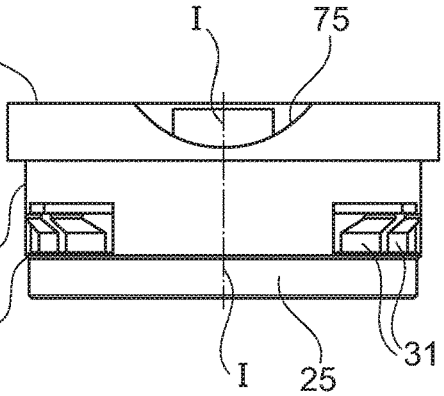
Figure 18:
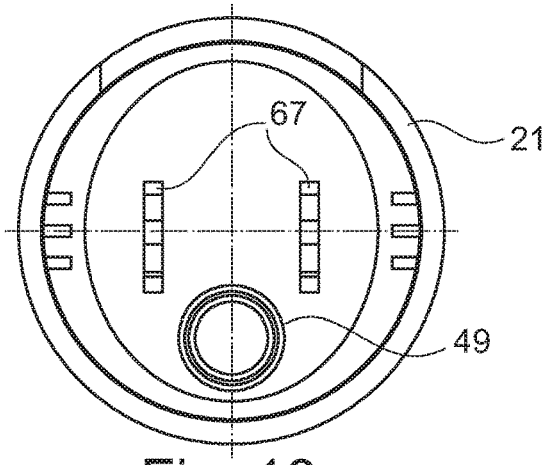
FIG. 18 shows an aerial view of the lower closure part from FIG. 11.
Figure 19:
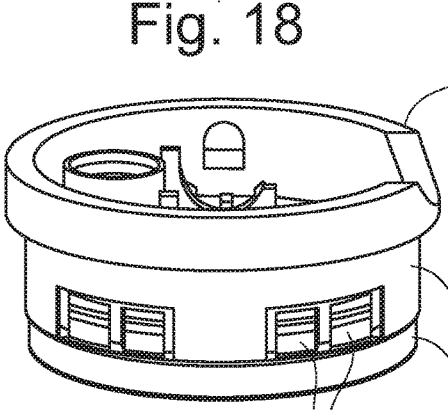
FIGS. 19 and 20 show two different perspective views of the lower closure part from FIG. 11.
Figure 20:
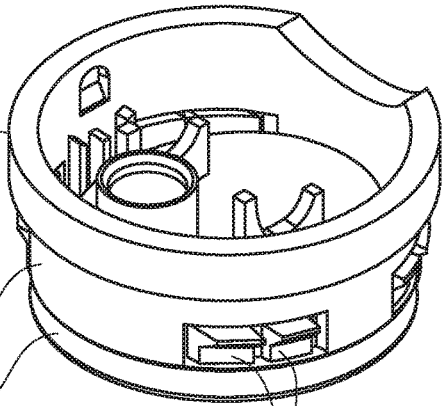

In the area of the step 27, a bottom 45 is formed on an internal wall 43 of the lower closure part 13, which closes a container interior defined by the container against the environment with a lower closure part 13 inserted into the opening 51 of a container. The bottom 45 has a pouring opening 47 (see FIG. 5), which opens into a pouring spout 49 on the cap side (FIGS. 9 and 10).

The lower closure part 13 is formed to be inserted into an opening 51 of a container and to seal the container together with the cap 17. For this purpose, a circumferential undercut 53 is formed at the opening 51, on which the locking projections 31 can engage with the second leg 35 protruding over an outer wall of the collar 19.

The container mouth 51 has a front annular section 55 having a first inner diameter and a rear annular section 57 having a second inner diameter. The two internal diameters of the annular sections 55,57 correspond to a respective outer diameter of the first 23 and second collar portion 25. In the depicted first embodiment, the first collar portion 23 seals the container interior against the environment, since the bottom 45 attaches above the penetrations 29. The cap 17 for closing the pouring spout 49 has a front wall 59 with a peripheral edge 61 projecting downwards, which corresponds to the opening 63 of the lower part 13.

The cap 17 is designed as a rocker, which is supported with two support elements 65 being integrally formed on the lower side of the cap 17, semi-circular and opposite one another on two supports 67 being positioned at an interval from one another and corresponding with the support elements 65. Also on the underside of the cap 17, a protruding annular section 69 is provided, which protrudes in the closing position of the cap 17 into an opening of the pouring spout 49 and closes this. For the pivotable fixing in the lower closure part 13, the cap 17 has integrally formed two protruding noses on opposite sides of the rim 61 shown in the figures), which can engage into diagonally opposite cavities 71 of an internal wall 73. To open the closure, the cap 17 is pushing downwards on one side (on the right in FIG. 1), wherein a finger recess 75 facilitates the depression. Between the penetrations 29, a plurality of axial extending reinforcing ribs 76 are formed on an inner side of the first collar portion 23, which stabilize the narrow wall portion between the adjacent penetrations 29.

The embodiment according to FIGS. 11 to 20 differs from the first substantially in the fact that the bottom 45 attaches below the penetrations 29. Accordingly, the second collar portion 25 is formed as a sealing surface, which rests tightly against the content stored in the container on the rear annular section 57. As can be seen from the figures, the bottom 45 is stepped. It comprises an annular edge portion 77 and an internal bottom surface 79 being detached from this, which adjoins the annular edge portion 77 by means of a notch or step 81.

Figure 21:
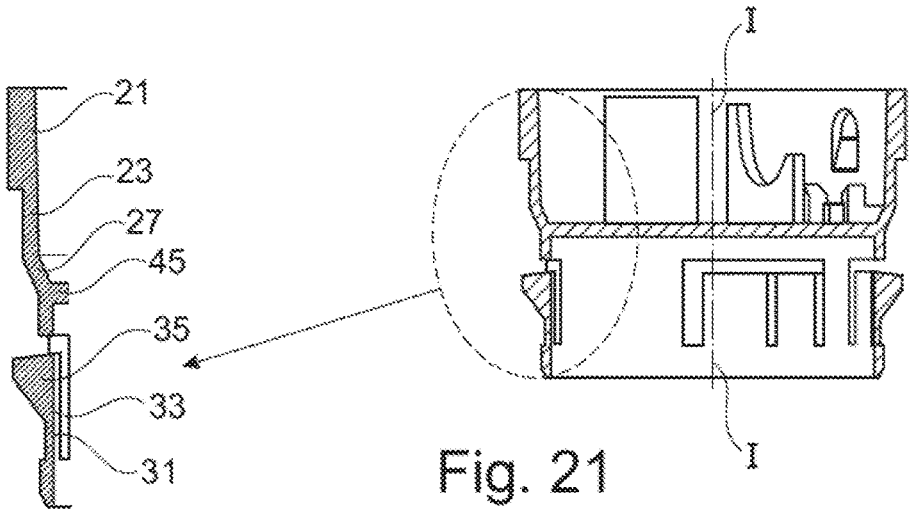
FIG. 21 shows a third embodiment of a lower closure part with a larger locking projection.
Figure 22:
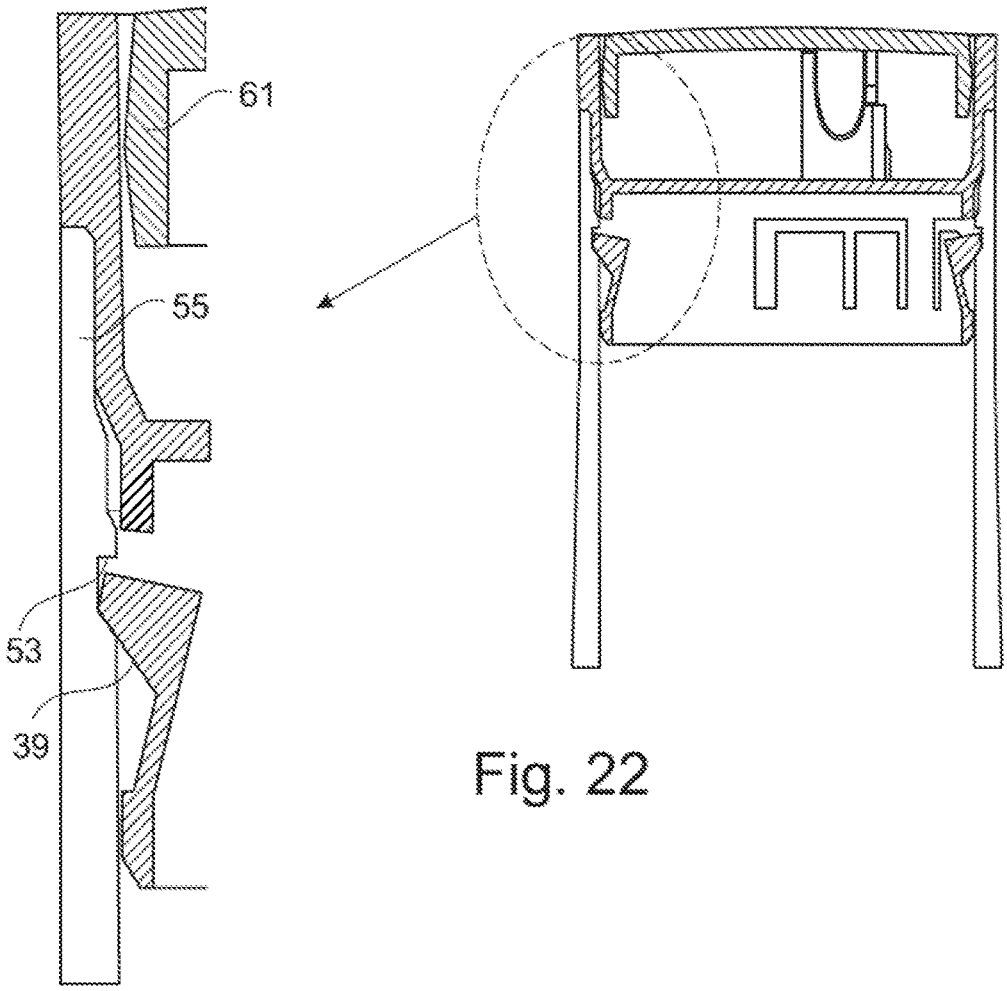
FIG. 22 shows the lower closure part of FIG. 21 inserted into the opening of a container.

The embodiment according to the FIGS. 21 and 22 shows a further outwardly projecting locking projection 31 in comparison to the first embodiment, which produces a higher radial pressure in the case of a lower closure part 13 being inserted into the opening 51 in comparison to the previous embodiments. As is apparent from the detailed enlargements of FIGS. 4 and 22, an interval exists between the undercut 53 and the locking protrusion 31, so that a locking of the undercut 53 and the locking projection 31 is guaranteed irrespective of the production tolerances.

Figure 23:
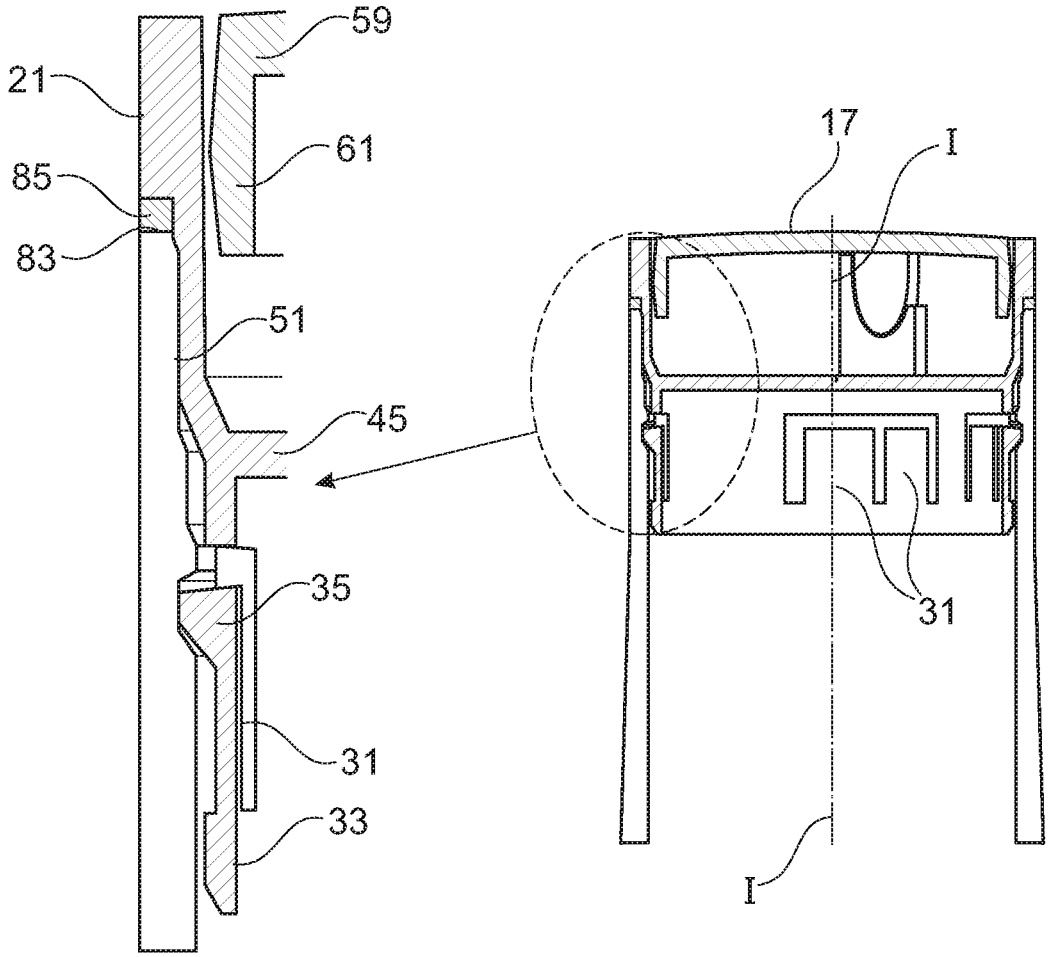
FIG. 23 shows a closure inserted into the opening of a container with an additional sealing ring on the front wall of the opening.

The embodiment according to FIG. 23 differs from the first embodiment in that a flat seal 85 is inserted between a front wall 83 adjoining the opening 51 and the annular step 22 extending substantially transverse to the center axis I-I of the band 21.

The proposed container closure can be produced using the injection molding process from the conventional thermoplastic plastics such as PET, PP, PE and their mixtures. It may be placed onto openings of any materials such as plastic, glass or metal.

The invention relates to a container closure 11 made of plastic, comprising a lower closure part 13, which can be fastened to an opening 51 of a container. According to the invention, the lower closure part 13 has a collar 19, which can be inserted into the opening 51 of the container. The at least one locking projection 31 can be moved in the direction of a center axis I-I of the lower closure part 13 in a reversible elastic manner in relation to the collar 19. The at least one locking projection 31 is designed in such a way that, when the at least one locking projection 31 and an undercut 53 shaped in the opening 51 engage with each other, the at least one locking projection and said undercut form a lock that cannot be detached in the direction of the center axis I-I.

The invention claimed is:

1. A container closure made of plastic, comprising:

a lower closure part fastenable to an opening of a container, the lower closure part having a collar insertable into the opening of the container and having at least one locking projection, the at least one locking projection movable in a direction of a center axis of the lower closure part in a reversible elastic manner in relation to the collar, the at least one locking projection configured so that when the at least one locking projection and an undercut formed in the opening engage with on another, the at least one locking projection and the undercut form a lock that is undetached in the direction of the center axis, wherein the collar defines at least one through-hole and the at least one locking projection is movable through the at least one through-hole.

2. The container closure of claim 1, wherein a reversibly elastic portion of the at least one locking projection has a first geometric configuration on a side facing the center axis of the reversibly elastic portion of the at least one locking projection and a second geometric configuration on an internal wall of the collar facing the center axis, the first and second geometric configurations substantially corresponding to one another.

3. The container closure of claim 1, wherein the collar comprises a base, wherein the base is located opposite a band that overlaps the opening when the lower closure part is inserted into the opening and wherein the at least one locking projection is integrally formed with the base and extends in a direction of the band.

4. The container closure of claim 1, wherein the collar is integrally formed on a larger-diameter band and further comprising an annular step between the band and the collar.

5. The container closure of claim 4, wherein the annular step is formed as an annular surface extending substantially transverse to the center axis.

6. The container closure of claim 4, wherein the collar comprises a first collar portion having a first external diameter adjacent to the annular step and a second collar portion having a second external diameter adjoining the first collar portion, wherein the second external diameter is smaller than the first external diameter.

7. The container closure of claim 6, further comprising a sealing surface formed on the first collar portion and a bottom formed circumferentially to an internal wall of the collar and wherein the bottom is located above the at least one through-hole.

8. The container closure of claim 7, wherein the sealing surface is formed conically on the first collar portion and wherein a diameter of the sealing surface is enlarged in a direction toward the band.

9. The closure of claim 6, further comprising a sealing surface formed on the second collar portion and a bottom formed circumferentially to an internal wall of the collar and wherein the bottom is located below the at least one through-hole.

10. The container closure of claim 9, wherein the sealing surface is formed conically on the second collar portion and wherein a diameter of the sealing surface is enlarged in a direction toward the band.

11. The container closure of claim 1, wherein the at least one locking projection is generally L-shaped.

12. The container closure of claim 11, wherein the at least one locking projection comprises a reversibly elastic portion forming a first axial leg, a first end of which is non-detachably connected to the collar, and a second leg, wherein the first leg and the second leg include a predefined angle therein between and wherein the second leg is non-detachably connected to a second end opposite the first end of the first leg.

13. The container closure of claim 12, wherein the second leg forms a wedge.

14. The container closure of claim 13, wherein the wedge comprises a first wedge surface facing away from the second end of the first leg and a second wedge surface facing towards the second end of the first leg.

15. The container closure of claim 14, wherein the first wedge surface and the first leg define an angle of between 75° and 90°.

16. The container closure of claim 14, wherein the first wedge surface and the first leg define an angle of between between 80° and 89°.

17. The container closure of claim 14, wherein the first wedge surface and the first leg define an angle of between 82° and 88°.

18. A container, comprising:

a plastic container closure having a lower closure part fastenable to an opening of the container, the lower closure part having a collar insertable into the opening of the container and having at least one locking projection, the at least one locking projection movable in a direction of a center axis of the lower closure part in a reversible elastic manner in relation to the collar, the at least one locking projection configured so that when the at least one locking projection and an undercut formed in the opening engage with on another, the at least one locking projection and the undercut form a lock that is undetached in the direction of the center axis, wherein the collar defines at least one through-hole and the at least one locking projection is movable through the at least one through-hole.

19. The container of claim 18, wherein the collar is integrally formed on a larger-diameter band and further comprising an annular step between the band and the collar.

20. The container of claim 19, wherein the collar comprises a first collar portion having a first external diameter adjacent to the annular step and a second collar portion having a second external diameter adjoining the first collar portion, wherein the second external diameter is smaller than the first external diameter.

21. The container of claim 20, further comprising a sealing surface formed on the first collar portion and a bottom formed circumferentially to an internal wall of the collar and wherein the bottom is located above the at least one through-hole, wherein the opening is formed to sealingly cooperate with the sealing surface of the first collar portion of the collar of the container closure.

22. The container of claim 20, further comprising a sealing surface formed on the second collar portion and a bottom formed circumferentially to an internal wall of the collar and wherein the bottom is located below the at least one through-hole, wherein the opening is formed to sealingly cooperate with the sealing surface of the second collar portion of the collar of the container closure.

23. The container of claim 19, further comprising a sealing ring arranged between a front wall of the opening and the annular step of the container closure.

24. The container of claim 18, wherein the container comprises a bottle or a tube.

25. The container of claim 18, wherein the opening comprises a front annular section having a first internal diameter and a rear annular section having a second internal diameter, wherein the front annular section extends from an edge limiting the opening in the direction of a container base positioned opposite the opening and the rear annular section adjoins the front annular section, wherein the second internal diameter is smaller than the first internal diameter.

26. The container of claim 18, wherein the undercut comprises a cavity or an elevation.

* * * * *